US009422705B2

(12) United States Patent
Akar

(10) Patent No.: US 9,422,705 B2
(45) Date of Patent: Aug. 23, 2016

(54) MOVABLE FLUSHABLE TOILET BOWL

(71) Applicant: Jay Akar, San Clemente, CA (US)

(72) Inventor: Jay Akar, San Clemente, CA (US)

( * ) Notice: Subject to any disclaimer, the term of this patent is extended or adjusted under 35 U.S.C. 154(b) by 0 days.

(21) Appl. No.: 14/594,078

(22) Filed: Jan. 9, 2015

(65) Prior Publication Data

US 2016/0201312 A1 Jul. 14, 2016

(51) Int. Cl.
*E03D 11/17* (2006.01)
*E03D 7/00* (2006.01)

(52) U.S. Cl.
CPC . *E03D 11/17* (2013.01); *E03D 7/00* (2013.01)

(58) Field of Classification Search
CPC ..... E03D 7/00; E03D 11/17; E03D 11/12; E03D 1/012
See application file for complete search history.

(56) References Cited

U.S. PATENT DOCUMENTS 2,428,462 A 10/1947 Levin
2,527,270 A 10/1950 Levin
4,797,959 A * 1/1989 Decaux ..... E03D 9/002 4/312
5,031,249 A 7/1991 Sargent
5,765,237 A * 6/1998 Okamoto ..... E03D 11/12 4/300
5,913,610 A 6/1999 Duck
2004/0237188 A1 12/2004 Marcellus
2005/0139265 A1 6/2005 Krywitsky

OTHER PUBLICATIONS

DigInfo TV; Bedside Flushable Toilet from TOTO; Tokyo, Japan; Sep. 20 2013; (www.diginfo.tv/v/13/0071-r-en.php).
Rakuten Global market; TOTO bedside flush toilet EWRS310; Tokyo, Japan; Jan. 8, 2015; (global.rakuten.com/en/store/apade/item/ewrs310/?s-id=borderless_recommend_item_en).
PCT, International Search Report and Written Opinion; Patent Application No. PCT/US15/51805 (Dec. 22, 2015).

* cited by examiner

*Primary Examiner* — Janie Loeppke
(74) *Attorney, Agent, or Firm* — Halit N. Yakupoglu

(57) ABSTRACT

A portable toilet system for people with mobility problems is provided. The system includes a stationary docking unit having a sewer port and a water tank with a flush mechanism, and a mobile toilet unit having a toilet bowl formed on a mobile base. The mobile toilet unit is configured to be attached to the stationary docking unit after used by a user so that the toilet bowl is flushed with water from the water tank by activating the flush mechanism so as to remove waste from the toilet bowl and discharge the waste through the sewer port of the stationary unit.

13 Claims, 8 Drawing Sheets

MOVABLE FLUSHABLE TOILET BOWL

BACKGROUND

1. Field of the Invention

The present invention relates to portable toilets, more particularly, to a flushable portable toilet capable of transporting the waste from the portable toilet to a conventional waste system by flushing.

2. Description of the Related Art

Currently, the US population numbers over 300 million. With a population that has a high percentage of elderly, obese, and diabetic members, many will eventually suffer from mobility problems including problems with gait, knee problems, hip and other skeletal, joint, and muscles issues that hinder mobility. For example, approximately 25% of the population is made up of senior citizens that have varying levels of such mobility problems depending on their age. Approximately 30% of adults suffer from obesity that results in damage primarily to their knees and joints. Furthermore, approximately 25% of the population suffers from diabetes, which in extreme cases causes amputations of the feet and legs. All these problems create physical disabilities for individuals; thus making it difficult to get to a bathroom and use a fixed toilet.

At private homes or nursing homes, there can be many reasons that people with reduced mobility have trouble getting to the bathroom, for example: (a) The bathroom may be too far for someone who has trouble walking or pain in their legs; (b) Stroke and heart attack patients may not have full use of their arms and legs to get into the bathroom; (c) Bathroom can be too small in homes therefore being difficult to enter with a wheelchair, walker, cane, etc.; (d) Some people may have enough strength to get out of bed and stand, but not enough strength to walk to the bathroom; (e) Some individuals may have lost one or both legs (diabetes); (f) Some people may have trouble with bladder retention and need the toilet close by for quick access; (g) Some people may be too old and may not have enough strength to travel more than a few steps to get to the toilet; and, (h) Some people may use the bathroom very frequently throughout day.

In hospitals, a hospital patient, who is not confined to a bed, may rely on a shared bathroom located at a distance from his or her bed. As the patient walks the distance to the bathroom, especially at night, there is an increased risk of injury for the patient. If a patient is confined to a bed, this patient requires assistance from a caregiver to transfer them from a bed to a bathroom.

In all these situations getting to a bathroom may be so difficult for some people with reduced mobility that it may often be easier for the disabled individual or the caregiver to deal with a waste collection device located within the bedroom of the individual. Presently, the available waste collection devices include bedpans, commode chairs, and portable toilets. These devices are generally the only products available to help bring a toilet near a disabled person. A common problem with such devices is the step of removal of the waste, i.e., urine and feces and sterilization of the device for reuse. It is an extremely unpleasant chore especially for caretakers, nurses, and family members to have to clean these devices after use. In a standard home, it is not practical to wash these devices in sinks, bathtubs, showers, in the backyard, etc. First the feces and urine have to be poured into a regular or fixed toilet for flushing; then the device has to be washed and sterilized. The emptying and cleaning process can be often exacerbated due to unsanitary splashing during disposal of the waste. The splashing of the waste products around tends to create an additional mess that is difficult to manually clean.

As such, dealing with waste collection devices is always messy, unpleasant, and unsanitary because they may spread bacteria to other parts of the home. Therefore, alternative methods and devices are desired which are sanitary and convenient for a user with reduced mobility and which reduce the need for an attendant or a caregiver to handle waste for disposal and offer low maintenance and efficient cleanup by the caretaker.

SUMMARY

One aspect of the present invention includes a portable toilet system including a stationary docking unit including a sewer port and a water tank with a flush mechanism, and a mobile toilet unit including a toilet bowl formed on a mobile base, wherein the mobile toilet unit is configured to be attached to the stationary docking unit after used by a user so that the toilet bowl is flushed with water from the water tank by activating the flush mechanism so as to remove waste from the toilet bowl and discharge the waste through the sewer port of the stationary unit.

Another aspect of the present invention includes a flushable portable toilet including an upper section including a toilet bowl, a lower section including a wheelbase to move the toilet bowl between a use-location and a cleaning-location, a water inlet disposed adjacent an upper end of the toilet bowl, and a waste outlet disposed adjacent a bottom end of the toilet bowl, the waste outlet is closed when the toilet bowl is moved to the use-location, wherein at the cleaning-location the water inlet is adapted to receive a water flow through a sealed communication from an external flush tank to flush the toilet bowl to move waste through the waste outlet which is adapted to discharge the waste through a sealed communication to an external sewer port.

Yet another aspect of the present invention includes a method of human waste disposal to assist people having mobility problems including receiving waste in a portable toilet bowl having a wheelbase at a use-location, moving the portable toilet bowl on the wheelbase from the use-location to a cleaning-location, connecting the portable toilet bowl to an external water outlet so as to allow water to enter into the portable toilet bowl, connecting the portable toilet bowl to an external waste discharge port, and flushing the portable toilet bowl with the water from the external water outlet so as to purge the waste out of the portable toilet bowl through the external waste discharge port.

BRIEF DESCRIPTION OF THE DRAWINGS

These and other aspects and features of the present invention will become apparent to those of ordinary skill in the art upon review of the following description of specific embodiments of the invention in conjunction with the accompanying figures, wherein.

DETAILED DESCRIPTION OF THE PREFERRED EMBODIMENTS

Figure 1A:
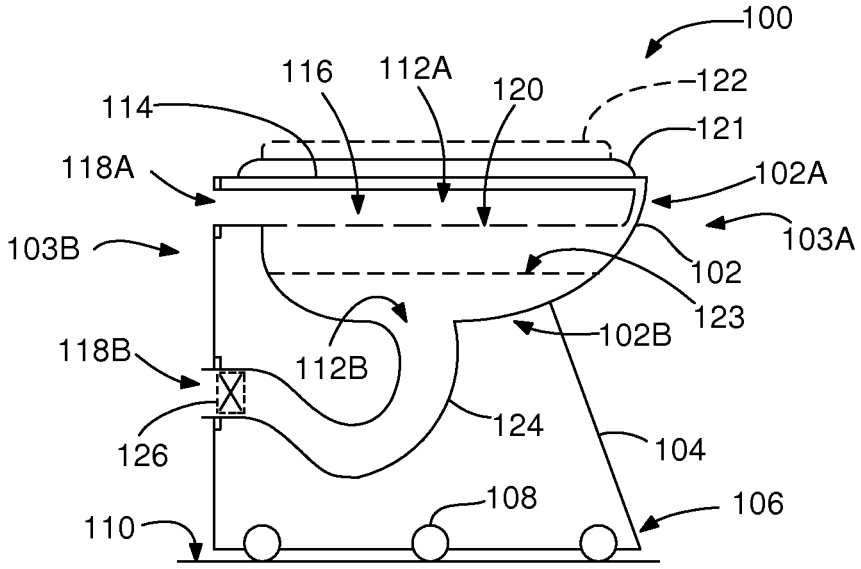
FIG. 1A is a schematic side view of an embodiment of a flushable portable toilet in a use-location.

The present invention provides embodiments of a mobile flushable waste disposal apparatus and system designed primarily for people with mobility health problems or other health problems that prevent such individuals from using conventional bathrooms in homes, hospitals, healthcare centers or nursing homes or other care facilities.

A mobile flushable waste disposal apparatus of the present invention may be designed to facilitate waste disposal in conjunction with a stationary unit or a docking station including a waste fluid inlet or sewer port and a fresh fluid outlet preferably connected to a fresh fluid tank including a flush mechanism. The stationary unit may preferably be located in a bathroom of where an individual with mobility problems lives or stays. The mobile flushable waste disposal apparatus may include a waste container or receptacle for example, a bowl formed on a mobile base including, for example, wheels or rollers or the like. It will be appreciated that the term bowl is not intended to limit the shape of the waste container; therefore the container may have any shape or geometry. At an upper section of the bowl, there may be a fresh fluid inlet configured to provide fresh fluid for the bowl when the bowl is flushed, a waste fluid outlet at a lower section of the bowl to discharge the waste fluid when the bowl is flushed and a bowl lid to cover the bowl when not used. The fresh fluid may refer to a liquid including water or fresh water or alternatively water containing a cleaning solution such as a cleaning detergent or bleach. The waste fluid refers to any such liquids with waste product deposited by the user of the apparatus. In one example, the mobile flushable waste disposal apparatus may stay in the bedroom of the individual suffering from reduced mobility and in close proximity of his or her bed so as to allow him or her to safely use the mobile flushable toilet when needed. For example, the mobile flushable waste disposal apparatus may stay in the bedroom of the individual throughout the night to allow him or her to use it conveniently many times without needing to walk to the bathroom. A seat cover or top lid may substantially seal top of bowl opening so as not to allow unpleasant odors from the bowl to spread inside the bedroom.

After one or more uses, the mobile flushable waste disposal apparatus with the deposited human waste such as feces and/or urine may be moved using the mobile base of the apparatus to the bathroom and connected to the stationary unit. The mobile flushable waste disposal apparatus may be connected to the stationary unit by connecting the waste fluid outlet of the bowl to the waste fluid inlet of the stationary unit and the fresh fluid outlet of the stationary unit to the fresh fluid inlet of the bowl. Once connected to the stationary unit, the bowl may be flushed with the fresh fluid from the fresh fluid tank to purge any waste remaining in the bowl through the waste outlet of the bowl into waste fluid inlet which may be connected to a sewage system of the building. After flushed and cleaned, the mobile flushable waste disposal apparatus may be again disconnected from the stationary unit and taken to the bedroom to be reused.

FIG. 1A shows an embodiment of a mobile flushable waste disposal apparatus designed as a mobile flushable toilet 100 of the present invention. As shown in FIG. 1A, the mobile flushable toilet 100, having a front side 103A and a rear side 103B, may include a waste bowl 102 formed on a bowl support 104 having a mobile base 106 that facilitates moving or transporting the mobile flushable toilet 100 from a use-location such as a bedroom of a user or person to a waste disposal location or cleaning-location such as a bath room and vice versa. The mobile base 106 may include wheels 108 or rolls to move the mobile flushable toilet 100 on a floor 110 of a building (not shown).

Referring to FIG. 1A, the waste bowl 102 of the mobile flushable toilet 100 may have an upper section 102A including an upper opening 112A for receiving a waste product from the user into the waste bowl 102. The upper opening 112A of the waste bowl 102 may be surrounded by a rim 114 under which a flush passage 116 is formed. The flush passage 116 may be connected to an inlet port 118A or inlet of the waste bowl 102 to receive the flushing fluid. The inlet port may be located at the rear side 103B of the mobile flushable toilet 100. The flush passage 116 may include a plurality of holes 120 designed to allow the flushing fluid to flow inside the waste bowl 102. A bowl seat 121 with a lid 122 may be hingeably attached to the rim 114 at the rear side 103B of the mobile flushable toilet 100. The bowl seat 121 and the lid 122 effectively seals the upper opening 112A of the waste bowl 102 when the lid is closed after the user deposits a waste product (not shown) into the waste bowl. Fluid surface 123 defines an approximate level of the fluid within the waste bowl 102 before the use or the fluid containing the waste product, i.e., waste fluid, after the use.

The lower section 102B of the waste bowl 102 includes a lower opening 112B connected to a discharge port 118B through a waste pipe 124 or trap line. The discharge port 118B may be located at the rear side 103B of the mobile flushable toilet 100. The waste pipe 124 allows waste to be carried from the interior of the waste bowl 102 to the discharge port 118B with the flushing fluid and out of the mobile flushable toilet 100 when the waste bowl 102 is flushed. A discharge valve 126 disposed within the discharge port 118B, which may be manually activated, may be used to open and sealably close the discharge port 118B. The discharge valve 126 is turned off before the mobile flushable toilet 100 is moved to the use-location and kept in closed position during the use. Once the mobile flushable toilet 100 is used by the user and the waste product is collected within the waste bowl 102, the mobile flushable toilet 100 may be moved back to the cleaning-location.

Figure 1B:
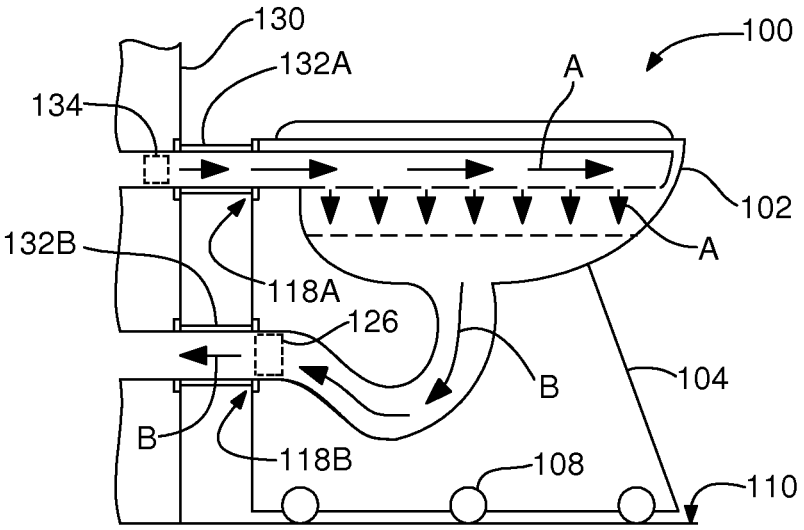
FIG. 1B is a schematic side view of the flushable portable toilet shown in FIG. 1A in a cleaning-location, wherein the flushable portable toilet has been connected to a waste water inlet and a water outlet.

As shown in FIG. 1B, at the cleaning-location, the mobile flushable toilet 100 may be positioned adjacent a docking structure 130 including a flushing fluid outlet 132A and a waste fluid inlet 132B or sewer port. The flushing fluid outlet 132A is connected to a flush tank (not shown) or a fluid pressure system, and the waste fluid inlet 132B is connected to a waste fluid or sewer drain (not shown). The docking structure 130 may be a bathroom wall portion including the flushing fluid outlet 132A and the waste fluid inlet 132B. The flushing fluid outlet 132A may include an outlet valve 134, which may be manually activated, and may be used to open and sealably close the flushing fluid outlet 132A to control the fluid flow. As the mobile flushable toilet 100 is positioned adjacent the docking structure 130, the inlet port 118A and the discharge port 118B of the waste bowl 102 are connected to the flushing fluid outlet 132A and the waste fluid inlet 132B, respectively, in a water-tight sealed manner. In order to flush the waste bowl 102, both the discharge valve 126 and the outlet valve 134 are placed in an open position, and a flush mechanism (not shown) is activated. Flushing fluid depicted with arrows 'A' from the flushing fluid outlet 132A and through the outlet valve 134, which is in the open position, flows into the interior of the waste bowl 102 through the inlet port 118A. The flushing fluid 'A' released into the waste bowl 102 causes flushing action and purges the waste fluid depicted with arrows 'B' from the waste bowl 102. With the flushing action, the waste fluid 'B' including the waste product flows through the discharge port 118B and through the discharge valve 126, which is in an open position, and into the waste fluid inlet 132B. In this respect, the flushing fluid may be water, i.e., fresh water, or a mixture of water and a cleaning solution which may include disinfectants or bleach. The waste fluid may be water containing any amount or type of waste product. The flushing action also introduces fresh fluid into the waste bowl 102 preparing it for another use. After flushing the waste bowl 102, both the outlet valve 134 and the discharge valve 126 are turned off and the mobile flushable toilet 100 may be disconnected from the docking structure 130 by pulling forward and taken to the use-location by wheeling it on the floor 110.

Figure 2A:
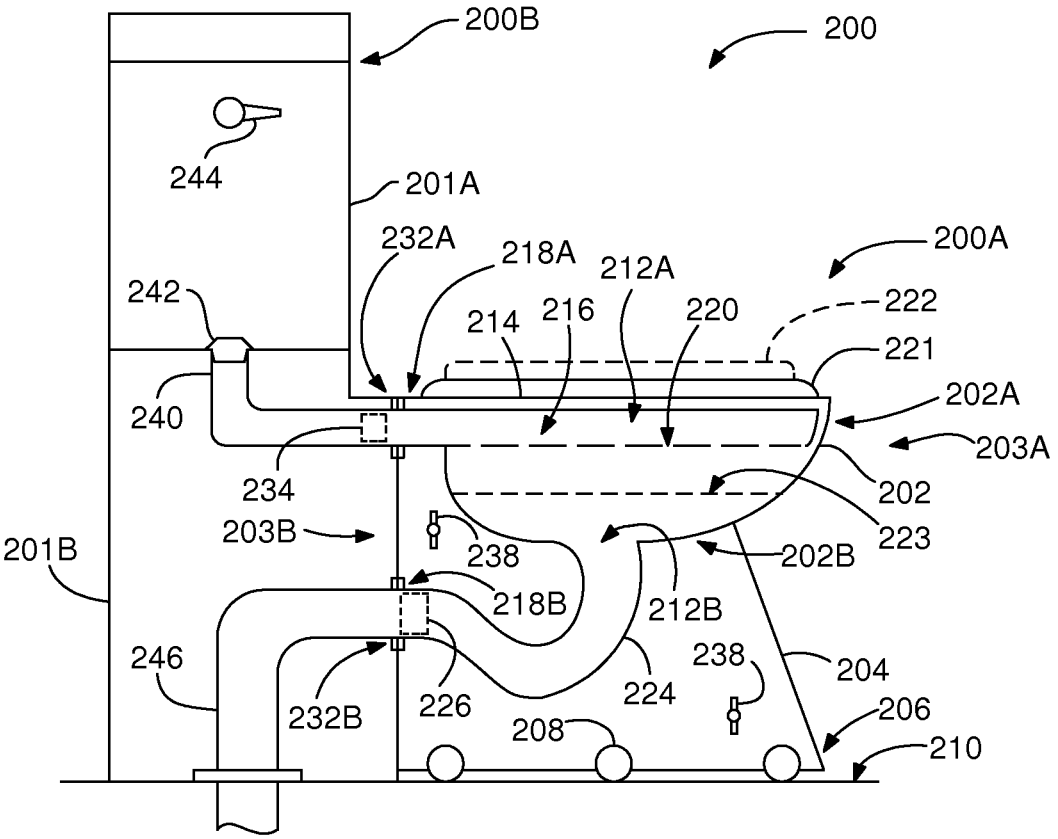
FIG. 2A is a schematic side view of an embodiment of a flushable portable toilet system including a stationary unit and a movable flushable toilet bowl shown at a cleaning-location, wherein the movable flushable toilet bowl has been attached to the stationary unit at the cleaning-location.

FIGS. 2A-2D show an embodiment of a mobile flushable waste disposal system 200 including a mobile flushable toilet 200A and a stationary unit 200B or a docking structure. Referring to FIG. 2A, the mobile flushable toilet 200A is shown as connected to the stationary unit 200B at a cleaning or waste disposal location, such as a bathroom. As in the previous embodiment described above, the mobile flushable toilet 200A, having a front side 203A and a rear side 203B, may include a waste bowl 202 formed on a bowl support 204 having a mobile base 206 that facilitates moving or transporting the mobile flushable toilet 200A from the use-location, e.g., bedroom, to the cleaning-location, e.g., bathroom, and vice versa. The mobile base 206 may include wheels 208 or rolls to move the mobile flushable toilet 200A on a floor 210 of a building (not shown). In one embodiment there may be six wheels 208 or rollers, which may be coated with rubber.

Referring to FIG. 2A, the waste bowl 202 may have an upper section 202A including an upper opening 212A for receiving waste product into the waste bowl 202. A rim 214 surrounds the upper opening 212A of the waste bowl 202. A flush passage 216 formed under the rim 214 may be connected to an inlet port 218A or inlet to receive the flushing fluid. The inlet port may be located at the rear side 203B of the mobile flushable toilet 200A. The flush passage 216 may include a plurality of holes 220 designed to allow the flushing fluid to flow inside the waste bowl 202. A combination of a bowl seat 221 with a lid 222 may be hingeably attached to the rim 214 at the rear side 203B. The bowl seat 221 and the lid 222 effectively seals the upper opening 212A of the waste bowl 202 when the lid 222 is closed after the user deposits a waste product (not shown) into the waste bowl 202. There may be a seal, such as a rubber seal (not shown) between the rim 214 and the bowl seat 221, and also between the bowl seat 221 and the lid 222 to effectively the seal the waste bowl 202 during transportation or when not used. The seal prevents any leakage of fluid or unpleasant odors. Fluid surface 223 exemplifies an approximate level of the fluid within the waste bowl 202 before the use or the fluid containing the waste product, i.e., waste fluid, after the use.

The lower section 202B of the waste bowl 202 includes a lower opening 212B connected to a discharge port 218B through a waste pipe 224 or trap line. The discharge port 218B may be located at the rear side 203B of the mobile flushable toilet 200A. The waste pipe 224 allows waste product to be carried from the interior of the waste bowl 202 to the discharge port 218B with the flushing fluid and to the exterior of the mobile flushable toilet 200A when the waste bowl is flushed. A discharge valve 226 disposed within the discharge port 218B, which may be manually activated, may be used to open and sealably close the discharge port 218B. The discharge valve 226 is turned off before the mobile flushable toilet 200A is moved to the use-location and kept in closed position during the use.

Figure 2B:
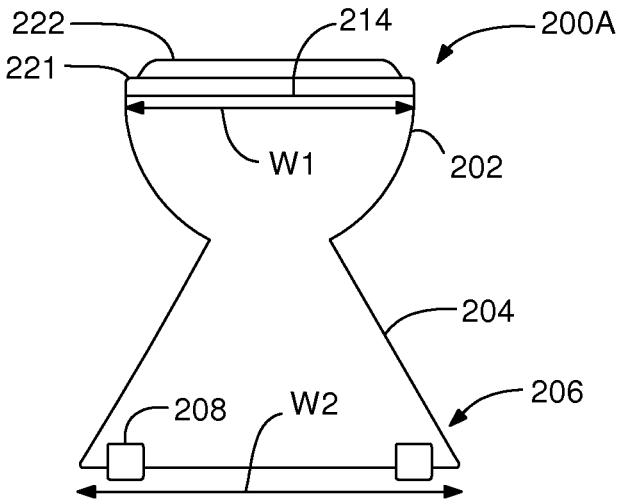
FIG. 2B is a schematic frontal view of the movable flushable toilet bowl shown in FIG. 2A.

As shown in FIG. 2B, in a frontal view of the mobile flushable toilet 200A from the front side 203A, a first width W1 of the mobile flushable toilet 200A is less than the second width W2 to form a wider base and thus better balance the mobile flushable toilet 200A. The first width W1 may be the width of the upper section 202A of the waste bowl 202 such as the width of the rim 214 surrounding the upper opening 212A, and the second width W2 may be the width of the mobile base 206 of the bowl support 204 as shown in FIG. 2B.

Referring back to FIG. 2A, at the cleaning-location, the mobile flushable toilet 200A may be connected to the stationary unit 200B and may be kept together using mechanical locks 238 and by placing them in a lock position. The stationary unit 200B located at the cleaning-location may include a flush tank 201A holding flushing fluid and a base 201B including a flushing fluid outlet 232A and a waste fluid inlet 232B or sewer port. In this embodiment, the flush tank 201A may be connected to the flushing fluid outlet 232A through a fluid pipe 240. Fluid flow from the flush tank 201A into the fluid pipe 240 is controlled by a flush tank valve 242. The flush tank valve 242 may be activated by a flush mechanism 244 to release the fluid stored within the flush tank 201A for flushing the waste bowl 202. The flushing fluid outlet 232A may include an outlet valve 234, which may be manually activated, and may be used to open and sealably close the flushing fluid outlet 232A to control the fluid flow. The waste fluid inlet 232B or sewer port is connected to a waste fluid drain 246 or sewer drain. As shown in FIG. 2A, when the two components, the mobile flushable toilet 200A and the stationary unit 200B of the system 200 are connected, the inlet port 218A and the discharge port 218B are connected to the flushing fluid outlet 232A and the waste fluid inlet 232B, respectively, in a water-tight sealed manner. In order to flush the waste bowl 202, both the discharge valve 226 and the outlet valve 234 are placed in an open position, and the flush mechanism 244 is activated to release the flushing fluid. Optionally, a spray system (not shown) may be placed within the waste bowl 202 adjacent the rim 214 and under the combination of a bowl seat 221 with a lid 222. Before flushing the waste bowl 202, the spray system may be used to spray water, or water including a cleaning solution, under the lid and interior of the rim 214 to clean their surfaces. At this connected state, the system 200 may function as a standard flushable toilet if needed.

Figure 2C:
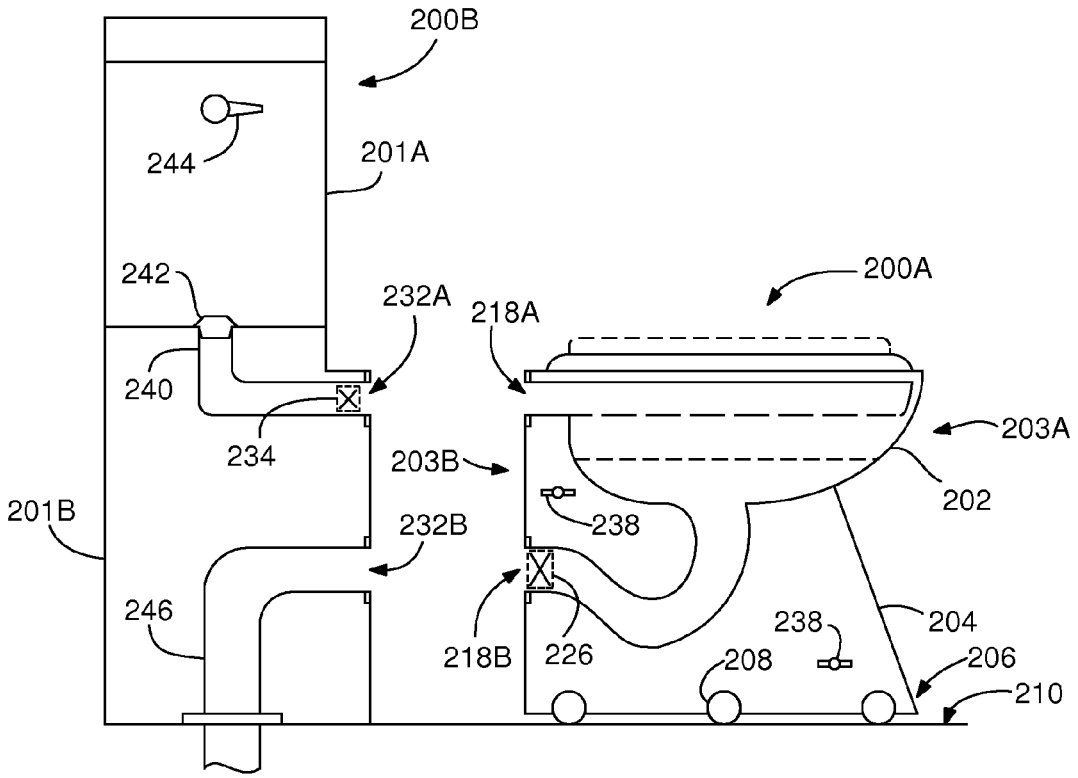
FIG. 2C is a schematic view showing that the movable flushable toilet bowl has been detached from the stationary unit and taken to a use-location to be used by a user.

Referring to FIG. 2C, after turning off both the outlet valve 234 and the discharge valve 226, and after unlocking the mechanical locks 238, the mobile flushable toilet 200A may be disconnected from the stationary unit 200B by pulling forward and moved to the use-location on the mobile base 206. Once the mobile flushable toilet 200A is used by the user and the waste product is collected, the mobile flushable toilet 200A may be moved back to the cleaning-location for flushing and cleaning service. Although not shown in the figures, each of the flushing fluid outlet 232A, sewer port 232B, inlet port 218A and discharge port 218B may have lids to cover their openings when the mobile flushable toilet 200A is separated from the stationary unit 200B.

Figure 2D:
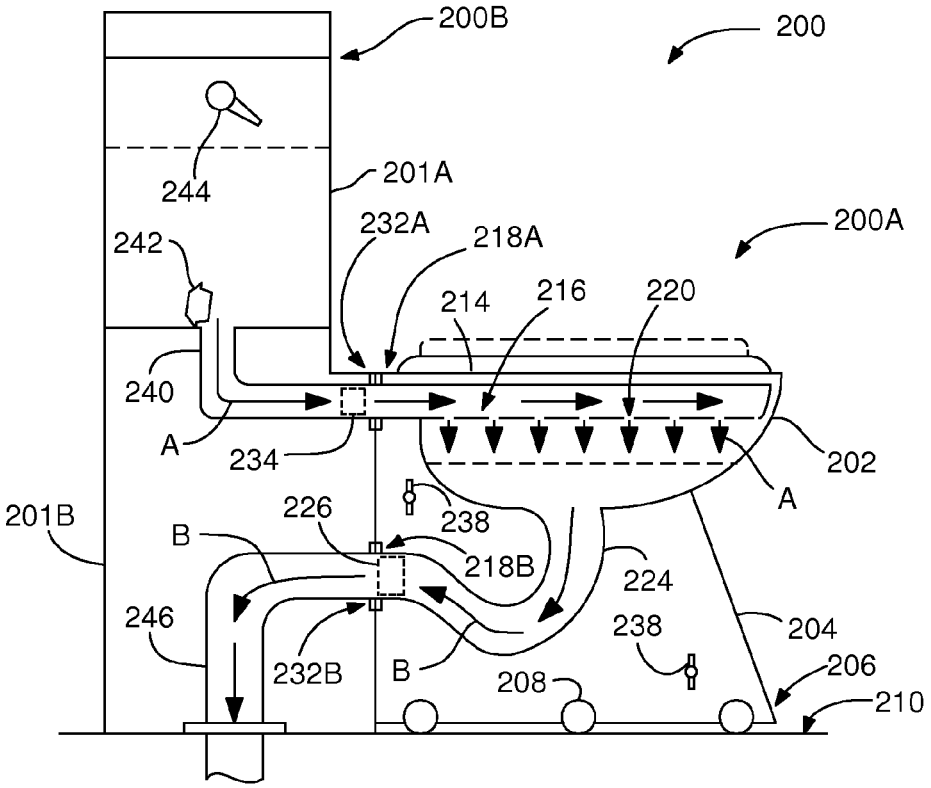
FIG. 2D is a schematic view showing that the movable flushable toilet bowl has been returned to the cleaning-location from the use-location and attached to the stationary unit to be flushed and cleaned.

Referring to FIG. 2D, at the cleaning-location, the mobile flushable toilet 200A may be connected to the stationary unit 200B as described above with respect to FIG. 2A, and the mechanical locks 238 are locked. After turning on both the outlet valve 234 and the discharge valve 226, the waste bowl 202 having the waste product is flushed as described above. Flushing fluid depicted with arrows 'A' from the flushing fluid outlet 232A and through the outlet valve 234, which is in the open position, flows into the interior of the waste bowl 202 through the inlet port 218A to replace the waste fluid collected therein. The flushing fluid 'A' released into the waste bowl 202 causes flushing action and purges the waste fluid depicted with arrows 'B' from the waste bowl 202 through the discharge port 218B and through the discharge valve 226, which is in the open position, into the sewer port 232B and the waste fluid drain 246. The flushing action also introduces fresh fluid into the waste bowl 202 preparing it for another use. After flushing the waste bowl 202, both the outlet valve 234 and the discharge valve 226 are placed into closed position and the mobile flushable toilet 200A may be disconnected from the stationary unit 200B by pulling forward and taken to the use-location by wheeling it on the floor 210. If so desired, the mobile flushable toilet 200A may also be kept attached to the stationary unit 200B at the cleaning-location to use it as a standard flushable toilet. As mentioned above, the flushing fluid may be water, i.e., fresh water, or a mixture of water and a cleaning solution which may or may not include disinfectants or bleach. The waste fluid may be water containing any amount or type of waste product.

Alternatively, a mobile flushable waste disposal system may be fully automatic and may be controlled by an electronic control system. In such system, the mobile flushable toilet may be separated from the docking station with a press of a button to activate release. When the toilet bowl separates from docking station, valves of the system may be automatically shut off to prevent leakages. When the mobile flushable toilet is returned to docking station, it clicks into a locking position and automatically deactivates the valves for the water inlet and drain so that bowl is fully connected to plumbing in the docking station and can be ready for flushing.

Figure 3A:
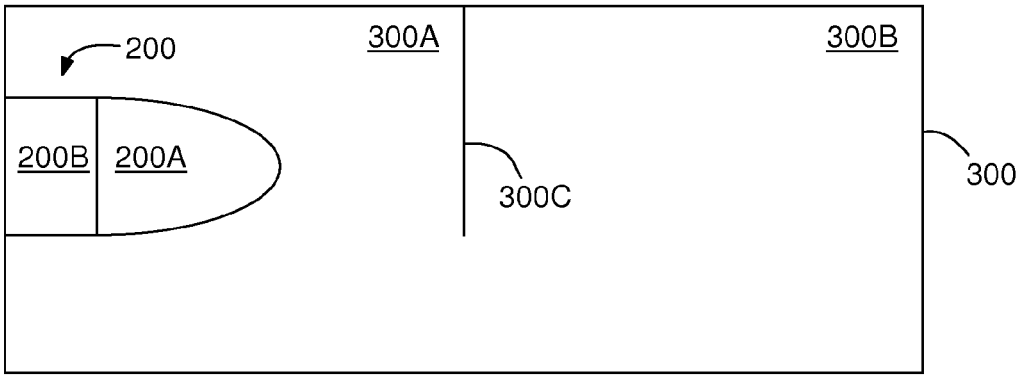
FIGS. 3A-3C are schematic top views exemplifying an embodiment of a method of using the portable toilet system of the present invention shown in FIGS. 2A-2C.
Figure 3B:
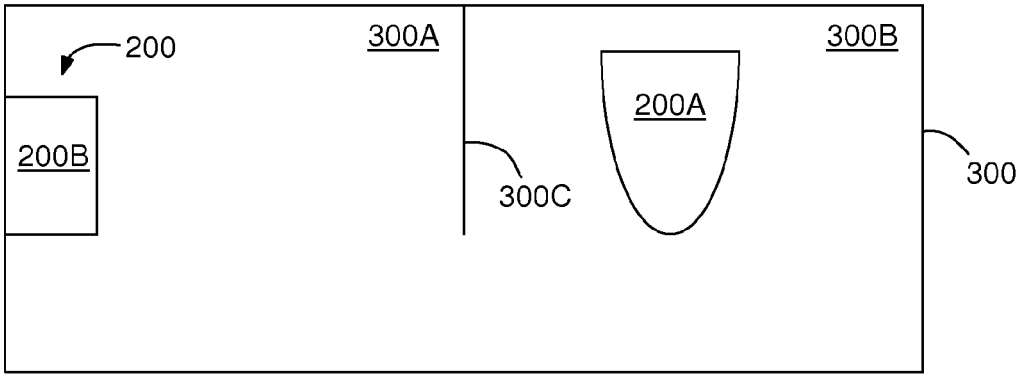
Figure 3C:
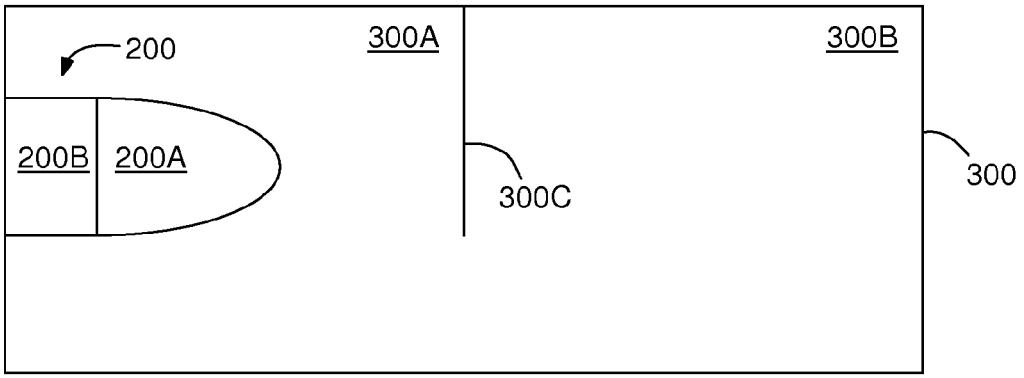

FIGS. 3A-3C illustrate an embodiment of an exemplary operation of the mobile flushable waste disposal system 200 including the mobile flushable toilet 200A and the stationary unit 200B or a docking unit in a building 300. The building 300 may include a cleaning-location 300A or a waste disposal location such as a bathroom separated from a use-location 300B, such as a bedroom of a user or person with reduced mobility, by a divider structure 300C. The divider structure 300C may be a wall separating the locations 300A and 300B, or a plurality of rooms between the locations 300A and 300B. As shown in FIG. 3A, at the cleaning-location 300A the mobile flushable toilet 200A and the stationary unit 200B are connected and the mobile flushable toilet 200A is flushable. As shown in FIG. 3B, the mobile flushable toilet 200A is separated from the stationary unit 200B as described above, and wheeled into the use-location 300B to be used by the user. Once the mobile flushable toilet 200A is used and the waste product is collected therein, the mobile flushable toilet 200A is wheeled back to the cleaning-location 300A. As shown in FIG. 3C, at the cleaning-location 300A, the mobile flushable toilet 200A and the stationary unit 200B are reconnected so that the mobile flushable toilet 200A can be flushed. In one configuration, the cleaning-location 300A may house a plurality of mobile flushable waste disposal systems having mobile flushable toilets and the stationary units to distribute one or more mobile flushable toilets to a plurality of use-locations, such as patient rooms in a hospital. In another configuration, the disposal location 300A may house only one or two stationary units and a plurality of mobile flushable toilets using the same stationary units. For example, the cleaning-location may have only one stationary unit but more than one mobile flushable toilets using the stationary unit to get flushed and for discharging the waste after returned from the use-locations. In this configuration, the mobile flushable toilets which are not used in the use-locations are stored in the cleaning-location or in a storage location in a ready to use clean state so as to be used when needed.

Figure 4A:
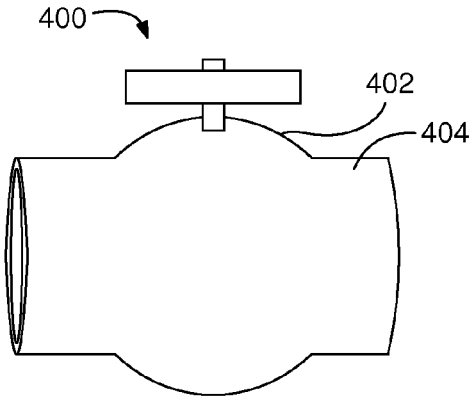
FIGS. 4A-4D are schematic illustrations of a ball valve used in the present invention.
Figure 4B:
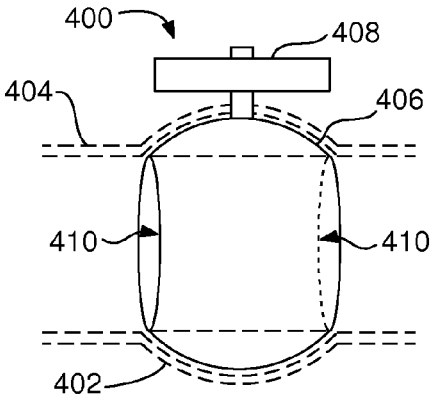

FIGS. 4A-4D show an exemplary valve 400 which may be used as either an outlet valve or a discharge valve, such as the valves 134 and 126 shown in FIGS. 1A-1B or the valves 234 and 226 shown in FIGS. 2A-2D. Referring to FIG. 4A, the exemplary valve 400 may be a ball valve including a chamber 402 or seat formed within a flow channel 404 through which a fluid or liquid, such as water, or a waste water, water with waste product, flows depending on the location of the valve. As can be seen in FIG. 4B, the chamber 402 is generally a spherical chamber housing a flow element 406 which is a ball shaped element conforming to the spherical shape of the chamber 402. The flow element 406 is connected to an external lever 408 which may move or rotate the flow element 406 into a closed position or an open position. The flow element 406 includes an orifice 410 permitting fluid flow through the flow element 406 only when the orifice 410 is aligned with the flow channel 404 by rotating the flow element within the chamber 402 using the external lever 408.

Figure 4C:
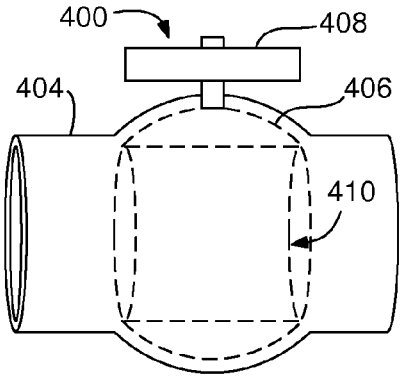
Figure 4D:
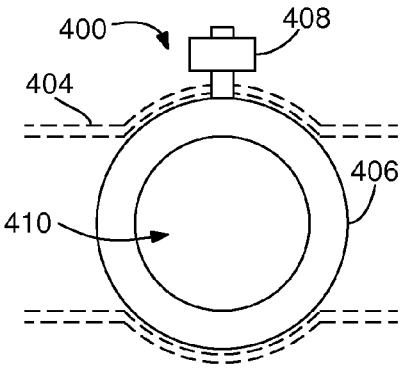

Referring to FIG. 4C, the orifice 410 is aligned with the flow channel 404 and thereby permits fluid flow through the flow element 406; hence the valve is in an open position. Referring to the FIG. 4D, by turning the flow element lever 408 for example 90 degrees by a quarter turn, the orifice 410 is no longer aligned with the flow channel and does not permit fluid flow through the flow element 406; hence the valve is in a closed position. These features of the ball valve 400 may be advantageously used for the outlet and the discharge valves of the present invention.

Figure 5A:
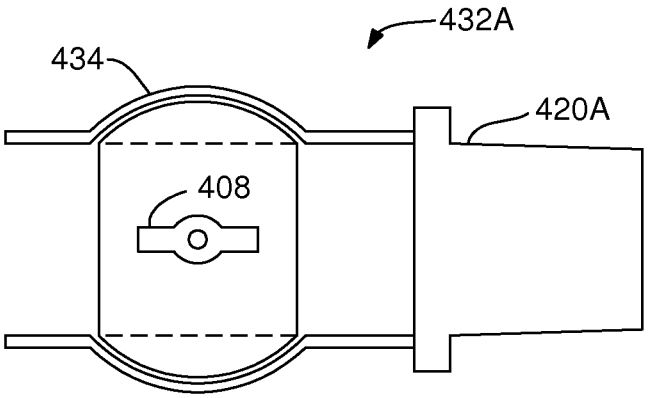
FIGS. 5A-5C are schematic illustrations showing and an embodiment of a water outlet of the stationary unit and an embodiment of a water inlet of the movable flushable toilet bowl.
Figure 5B:
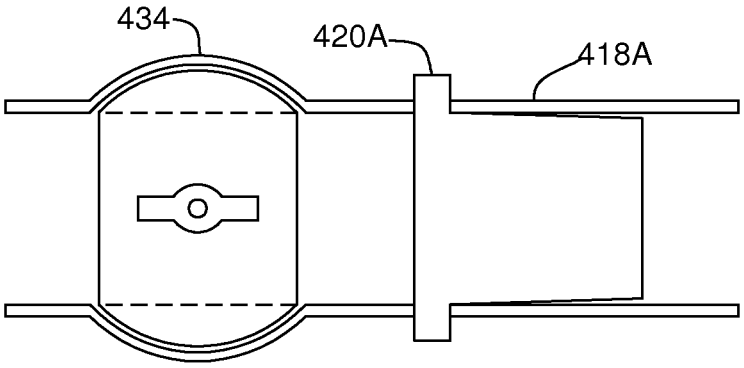
Figure 5C:
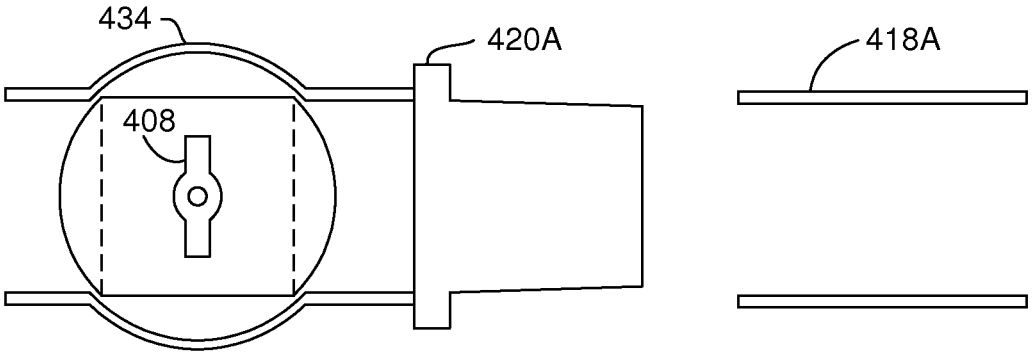

FIG. 5A shows an exemplary flushing fluid outlet 432A which may be used with the above embodiments. The flushing fluid outlet 432A of a stationary unit may include a fresh fluid valve 434 and a first seal 420A, which may be a flexible sealing material such as rubber or silicone surrounding the opening of the flushing fluid outlet 432A. As shown in FIGS. 5B and 5C, the first seal 420A water-tight seals the connection between the flushing fluid outlet 432A and the inlet port 418A of the mobile flushable toilet for example when the mobile flushable toilet is connected to the stationary unit as described above and prevents any fluid leakage or dripping.

Figure 6A:
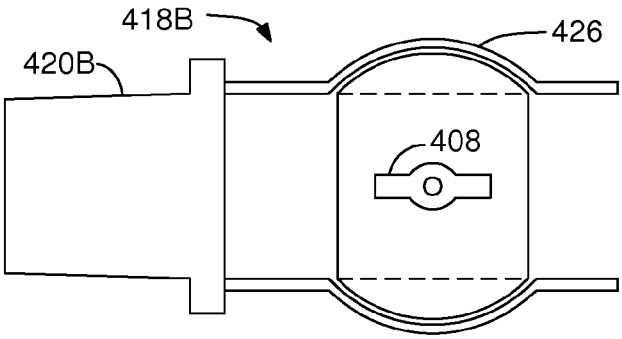
FIGS. 6A-6C are schematic illustrations showing an embodiment of a waste water outlet of the movable flushable toilet bowl and an embodiment of a waste water inlet of the stationary unit.
Figure 6B:
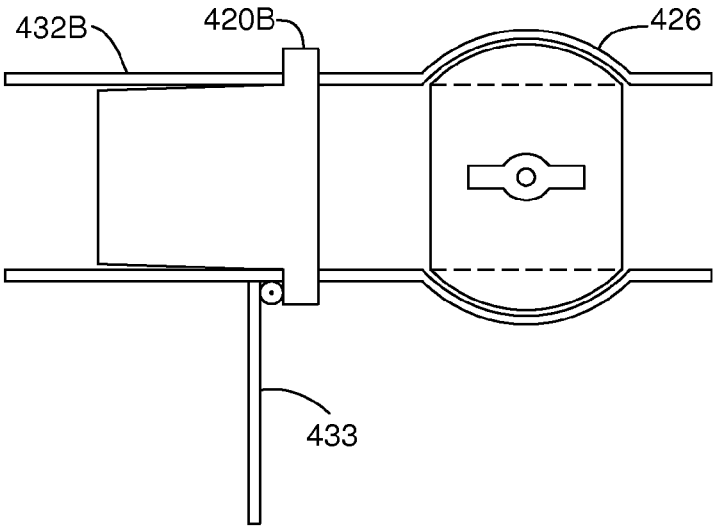
Figure 6C:
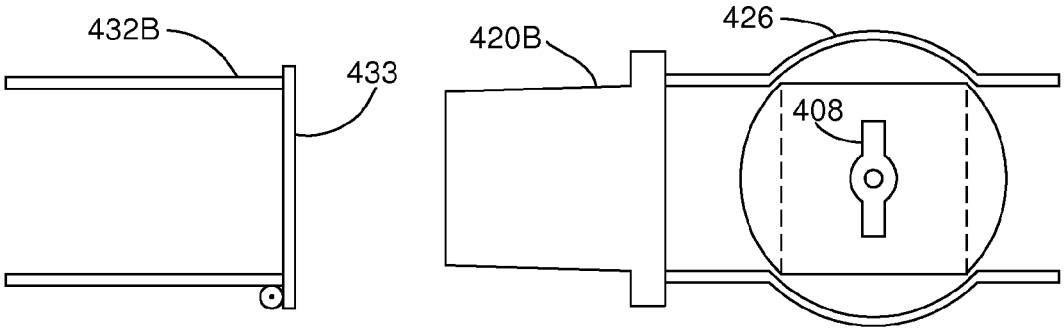

FIG. 6A shows an exemplary discharge port 418B which may be used with the above embodiments. The discharge port 418B may include a discharge valve 426 and a second seal 420B, which may be a flexible sealing material such as rubber or silicone. When the movable flushable toilet is being moved around, the discharge valve 426 is turned off and prevents any dripping. As shown in FIGS. 6B and 6C, the second seal 420B water-tight seals the connection between the discharge port 418B and the waste fluid inlet 432B for example when the movable flushable toilet is connected to the stationary unit as described above and prevents any waste fluid leakage or dripping. When the movable flushable toilet is in a use-location, a lid 433 covers and seals the waste fluid inlet 432B.

The mobile flushable toilet or portable toilet of the present invention can help people, especially people having mobility problems, gain easier access to a toilet. The mobile flushable toilet can be shaped, sized and manufactured like a standard toilet so that a person can conveniently use it in his bedroom with the same comfort. The mobile flushable toilet of the present invention can be easily rolled out of a bathroom to another part of the house, utilized like a standard toilet by a person that has trouble getting to the bathroom, rolled back to the bathroom into its original position, and finally flushed like a standard toilet. The wheels underneath the mobile flushable toilet can advantageously enable the mobile flushable toilet to leave docking station and travel to other locations within the home for use. The invention also eliminates the difficult, unsanitary, and unpleasant manual cleaning of urine and feces required by existing prior art portable toilets because it can be flushed like a standard toilet. The mobile flushable toilet system may also have the following features and advantages: (a) the wheels underneath the mobile bowl may have locks so that there is no movement of the toilet bowl when person is sitting down or getting up; (b) the water inside toilet bowl may have standard scented chemicals to kill bacteria and suppress odors of urine and feces inside bowl when used; (c) The toilet seat and lid may have an air tight seal when in the closed down position to contain urine and feces odors inside the toilet bowl; (d) when the mobile flushable toilet is attached to the docking station or when the mobile flushable toilet is connected to a standard home sewer drain and water supply, it is no different than any standard toilet in use and appearance (prior art mobile flushable toilets do not have this feature, which are basically independent holding containers).

Optionally, a mobile flushable toilet with a low bowl may be used for small children, which can be connected to the same docking station. Once the child gets taller he or she can start using the standard bowl size. If a home only has one bathroom, extra bowls may be bought and placed in other parts of the home to create additional usable mobile flushable toilets. After used, each bowl can be brought to the docking station to flush. The mobile flushable toilet bowl may have optional arm rests, back rest and hand rail to help with balance when sitting down and getting up from toilet bowl.

Although aspects and advantages of the present invention are described herein with respect to certain preferred embodiments, modifications of the preferred embodiments will be apparent to those skilled in the art. Thus the scope of the present invention should not be limited to the foregoing discussion, but should be defined by the appended claims.

I claim:

1. A portable toilet system, comprising:

a stationary docking unit including a sewer port and a water tank with a flush mechanism, the water tank being connected to a water outlet of the stationary docking unit, wherein the water outlet includes a manually-activated valve in sealed communication with the water outlet;

a mobile toilet unit including a toilet bowl formed on a mobile base, the toilet bowl including a water inlet and a waste port, wherein the waste port includes a manually-activated valve in sealed communication with the waste port, wherein after used by a user the mobile toilet unit is configured to be attached to the stationary docking unit by attaching the water inlet of the toilet bowl to the water outlet of the stationary docking unit and by attaching the waste port of the toilet bowl to the sewer port of the stationary docking unit and biasing both the manually-activated valve of the water outlet and the manually-activated valve of the waste port to an open position so that the toilet bowl is flushed with water from the water tank by activating the flush mechanism so as to remove waste from the toilet bowl and discharge the waste through the sewer port of the stationary docking unit, wherein the mobile toilet unit is configured to be detached from the stationary docking unit to be used by the user, the mobile toilet unit being detached from the stationary docking unit by detaching the water inlet of the toilet bowl from the water outlet of the stationary docking unit and by detaching the waste port of the toilet bowl from the sewer port of the stationary docking unit, both the manually-activated valve of the water outlet and the manually-activated valve of the waste port being biased to a closed position when the mobile toilet unit being detached from the stationary docking unit; and a locking system configured to hold the mobile toilet unit and the stationary docking unit together when the mobile toilet unit is attached to the stationary docking unit, the locking system includes mechanical locks disposed on the toilet bowl.

2. The portable toilet system of claim 1, wherein the water inlet is at an upper section of the toilet bowl and the waste port is at a lower section of the toilet bowl.

3. The portable toilet system of claim 1, wherein the water outlet of the stationary docking unit includes a first seal adapted to establish a sealed communication between the water outlet and the water inlet when the mobile toilet unit is attached to the stationary docking unit.

4. The portable toilet system of claim 1, wherein the waste port of the mobile toilet unit includes a second seal adapted to establish a sealed communication between the waste port and the sewer port when the mobile toilet unit is attached to the stationary docking unit.

5. The portable toilet system of claim 1 wherein the mobile base of the mobile toilet unit comprises a wheelbase including lockable wheels.

6. A flushable portable toilet, comprising:

an upper section including a toilet bowl having a water inlet disposed at an upper end of the toilet bowl and a waste outlet disposed at a bottom end of the toilet bowl, the waste outlet of the toilet bowl including a manually-activated valve; and a lower section including a wheelbase having wheels to move the toilet bowl between a use-location and a cleaning-location including an external sewer port and an external flush tank, the external flush tank and the external sewer port being on the same wall at the cleaning-location, wherein the waste outlet is closed by closing the manually-activated valve when the toilet bowl is moved to the use-location, wherein at the cleaning-location the waste outlet is opened by opening the manually-activated valve of the waste outlet and the water inlet is adapted to receive a water flow from the external flush tank through a sealed communication to flush the toilet bowl to move waste through the waste outlet which is adapted to discharge the waste through a sealed communication to the external sewer port.

7. The flushable portable toilet of claim 6, wherein the external flush tank having a manually-activated valve to release the water flow.

8. The flushable portable toilet of claim 7, wherein the external flush tank includes a water outlet having a first seal adapted to connect to the water inlet of the toilet bowl in a sealed communication.

9. The flushable portable toilet of claim 6, wherein the manually-activated valve of the waste outlet of the toilet bowl is opened at the cleaning-location when connected to the external sewer port and closed at the use-location.

10. The flushable portable toilet of claim 6, wherein the waste outlet of the toilet bowl includes a second seal adapted to connect to the external sewer port in a sealed communication.

11. A method of human waste disposal to assist people having mobility problems, comprising:

providing a cleaning location including an external water outlet and an external waste discharge port, wherein both the external water outlet and the external waste discharge port are on the same wall;

receiving waste in a portable toilet bowl having a wheelbase at a use-location, the portable toilet bowl having a water inlet and a waste outlet, the waste outlet of the toilet bowl including an outlet valve, wherein the waste outlet is closed by closing the outlet valve of the waste outlet when the toilet bowl is moved to the use-location;

moving the portable toilet bowl on the wheelbase from the use-location to the cleaning-location;

connecting the water inlet of the portable toilet bowl to the external water outlet at the cleaning-location so as to allow water to enter into the portable toilet bowl;

connecting the portable toilet bowl to the external waste discharge port at the cleaning-location by connecting the waste outlet of the portable toilet bowl to the external waste discharge port;

opening the outlet valve of the waste outlet; and flushing the portable toilet bowl with the water from the external water outlet so as to purge the waste out of the portable toilet bowl through the external waste discharge port.

12. The method of claim 11 further comprising opening an outlet valve of the external water outlet after connecting the external water outlet to the water inlet of the portable toilet bowl.

13. The method of claim 12 further comprising:

closing the outlet valve of the external water outlet;

closing the outlet valve of the waste outlet;

detaching the portable toilet bowl from the external water outlet and the external waste discharge port; and moving the portable toilet bowl from the cleaning-location to the use-location on the wheelbase.

* * * * *